US011359867B2

(12) United States Patent
Norén et al.

(10) Patent No.: US 11,359,867 B2
(45) Date of Patent: Jun. 14, 2022

(54) HEAT TRANSFER PLATE

(71) Applicant: ALFA LAVAL CORPORATE AB, Lund (SE)

(72) Inventors: Mattias Norén, Malmö (SE); Magnus Hedberg, Hjärup (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 17/291,911

(22) PCT Filed: Oct. 21, 2019

(86) PCT No.: PCT/EP2019/078489
§ 371 (c)(1),
(2) Date: May 6, 2021

(87) PCT Pub. No.: WO2020/094367
PCT Pub. Date: May 14, 2020

(65) Prior Publication Data

US 2021/0318070 A1 Oct. 14, 2021

(30) Foreign Application Priority Data

Nov. 7, 2018 (EP) ..... 18204819

(51) Int. Cl.
*F28D 9/00* (2006.01)
*F28F 3/04* (2006.01)
*F28F 3/08* (2006.01)

(52) U.S. Cl.
CPC ..... *F28D 9/005* (2013.01); *F28F 3/046* (2013.01); *F28F 3/083* (2013.01)

(58) Field of Classification Search
CPC ..... F28D 9/005; F28D 9/0043; F28D 9/0037; F28F 3/083; F28F 3/046; F28F 3/10
See application file for complete search history.

(56) References Cited

U.S. PATENT DOCUMENTS 4,781,248 A * 11/1988 Pfeiffer ..... F28D 9/005 165/166
7,040,387 B2 * 5/2006 Leuthner ..... F28F 9/0268 165/166

(Continued)

FOREIGN PATENT DOCUMENTS

CN 205279837 U 6/2016
CN 108700388 A 10/2018

(Continued)

OTHER PUBLICATIONS

International Search Report (PCT/ISA/210) and Written Opinion (PCT/ISA/237) dated Jan. 14, 2020, by the European Patent Office as the International Searching Authority for International Application No. PCT/EP2019/078489.

(Continued)

*Primary Examiner* — Jianying C Atkisson
*Assistant Examiner* — For K Ling
(74) *Attorney, Agent, or Firm* — Buchanan Ingersoll & Rooney PC

(57) ABSTRACT

A heat transfer plate comprises a first distribution area having a first distribution pattern, a second distribution area having a second distribution pattern, and a heat transfer area having a heat transfer pattern differing from the first and second distribution patterns. The first and second distribution patterns comprise distribution ridges and distribution valleys. Distribution ridges and distribution valleys of the first and second distribution patterns closest to the heat transfer area form end ridges and end valleys. The top portion of at least plural of the end ridges, along at least part of its longitudinal extension, has a second width exceeding a first width of the top portion of the remaining distribution ridges, and the bottom portion of at least plural of the end valleys, along at least part of its longitudinal extension, has (Continued)

a fourth width exceeding a third width of the bottom portion of the remaining distribution valleys.

15 Claims, 5 Drawing Sheets

(56) References Cited

U.S. PATENT DOCUMENTS

| | | | | |
|---|---|---|---|---|
| 9,739,542 | B2 | 8/2017 | Hedberg et al. | |
| 9,816,763 | B2 * | 11/2017 | Blomgren | F28F 3/046 |
| 2002/0192531 | A1 * | 12/2002 | Zimmerman | H01M 8/241 429/492 |
| 2004/0168793 | A1 | 9/2004 | Blomgren | |
| 2014/0251587 | A1 | 9/2014 | Persson | |
| 2015/0247682 | A1 * | 9/2015 | Nilsson | F28D 9/0043 165/185 |

FOREIGN PATENT DOCUMENTS

| | | | |
|---|---|---|---|
| EP | 3043139 | A1 | 7/2016 |
| EP | 3182048 | A1 | 6/2017 |
| EP | 3225947 | A1 | 10/2017 |
| EP | 3 396 295 | A1 | 10/2018 |
| GB | 1359954 | A | 7/1974 |
| RU | 2 008 602 | C1 | 2/1994 |
| RU | 2 561 356 | C1 | 8/2015 |
| SE | 528879 | C2 | 3/2007 |
| WO | 98/50746 | A1 | 11/1998 |
| WO | 2007004939 | A1 | 1/2007 |
| WO | 2017/144230 | A1 | 8/2017 |

OTHER PUBLICATIONS

Hisaka Plate Heat Exchanger Brochure; Hisaka Works, Ltd., Heat Exchange Division; 16 pages; exact publication date unknown but at least as early as Nov. 7, 2018.

English Translation of the Office Action (Decision to Grant) dated Aug. 25, 2021, by the Federal Service for Intellectual Property (ROSPATENT) in corresponding Russian Patent Application No. 2021116138/12(034056). (8 pages).

Office Action (The First Office Action) dated Sep. 1, 2021, by the State Intellectual Property Office of People's Republic of China in corresponding Chinese Patent Application No. 201980072948.9 and an English Translation of the Office Action. (8 pages).

Office Action (Examination Report) dated Feb. 10, 2022, by the Patent Office, Government of India, in corresponding India Patent Application No. 202117022287 with an English Translation of the Office Action. (5 pages).

* cited by examiner

HEAT TRANSFER PLATE

TECHNICAL FIELD

The invention relates to a heat transfer plate and its design.

BACKGROUND ART

Plate heat exchangers, PHEs, typically consist of two end plates in between which a number of heat transfer plates are arranged aligned in a stack or pack. The heat transfer plates of a PHE may be of the same or different types and they may be stacked in different ways. In some PHEs, the heat transfer plates are stacked with the front side and the back side of one heat transfer plate facing the back side and the front side, respectively, of other heat transfer plates, and every other heat transfer plate turned upside down in relation to the rest of the heat transfer plates. Typically, this is referred to as the heat transfer plates being "rotated" in relation to each other. In other PHEs, the heat transfer plates are stacked with the front side and the back side of one heat transfer plate facing the front side and back side, respectively, of other heat transfer plates, and every other heat transfer plate turned upside down in relation to the rest of the heat transfer plates. Typically, this is referred to as the heat transfer plates being "flipped" in relation to each other.

In one type of well-known PHEs, the so called gasketed PHEs, gaskets are arranged between the heat transfer plates. The end plates, and therefore the heat transfer plates, are pressed towards each other by some kind of tightening means, whereby the gaskets seal between the heat transfer plates. Parallel flow channels are formed between the heat transfer plates, one channel between each pair of adjacent heat transfer plates. Two fluids of initially different temperatures, which are fed to/from the PHE through inlets/outlets, can flow alternately through every second channel for transferring heat from one fluid to the other, which fluids enter/exit the channels through inlet/outlet port holes in the heat transfer plates communicating with the inlets/outlets of the PHE.

Typically, a heat transfer plate comprises two end portions and an intermediate heat transfer portion. The end portions comprise the inlet and outlet port holes and distribution areas pressed with a distribution pattern of ridges and valleys. Similarly, the heat transfer portion comprises a heat transfer area pressed with a heat transfer pattern of ridges and valleys. The ridges and valleys of the distribution and heat transfer patterns of the heat transfer plate is arranged to contact, in contact areas, the ridges and valleys of distribution and heat transfer patterns of adjacent heat transfer plates in a plate heat exchanger. The main task of the distribution areas of the heat transfer plates is to spread a fluid entering the channel across the width of the heat transfer plates before the fluid reaches the heat transfer areas, and to collect the fluid and guide it out of the channel after it has passed the heat transfer areas. On the contrary, the main task of the heat transfer area is heat transfer.

Since the distribution areas and the heat transfer area have different main tasks, the distribution pattern normally differs from the heat transfer pattern. The distribution pattern may be such that it offers a relatively weak flow resistance and low pressure drop which is typically associated with a more "open" distribution pattern design, such as a so-called chocolate pattern, offering relatively few, but large, contact areas between adjacent heat transfer plates. The heat transfer pattern may be such that it offers a relatively strong flow resistance and high pressure drop which is typically associated with a more "dense" heat transfer pattern design, such as a so-called herringbone pattern, offering more, but smaller, contact areas between adjacent heat transfer plates. Thus, the distance between adjacent contact areas within the distribution areas may typically be larger than the distance between adjacent contact areas within the heat transfer area.

A pack of aligned heat transfer plates is typically weaker where the distance between adjacent contact areas is relatively large. Further, at the transition between the distribution and heat transfer areas, i.e. where the plate pattern changes, the contact areas are typically relatively scattered which may negatively impact the strength of the heat transfer plate pack at the transition. Where the plate pack is less strong, it is more prone to deformation which could result in malfunctioning of the plate heat exchanger.

Applicant's Swedish patent SE 528879, which is hereby incorporated herein by reference, aims at providing an improved strength at the transition between distribution and heat transfer areas of a plate pack wherein the heat transfer plates are "rotated" in relation to each other. This is obtained by the provision of narrows band between the distribution and heat transfer areas, which narrow bands are provided with a herringbone pattern, more particularly densely arranged "steep" ridges and valleys offering densely arranged contact areas. Although SE 528879 discloses a solution that works very well, it is limited to heat transfer plate "rotated" in relation to each other and does not work for heat transfer plates "flipped" in relation to each other. This is because crossing of the patterns, and thus point type contact areas, is obtained when the heat transfer plates are "rotated" in relation to each other but not when they are "flipped" in relation to each other.

SUMMARY

An object of the present invention is to provide a heat transfer plate which at least partly solves the above discussed problem of prior art. The basic concept of the invention is to provide a transition strengthening solution which is more flexible than the above discussed prior art solution in that it is suitable for a heat transfer plate pack with heat transfer plates "rotated" as well as "flipped" in relation to each other. The heat transfer plate, which is also referred to herein as just "plate", for achieving the object above is defined in the appended claims and discussed below.

A heat transfer plate according to the present invention comprises a first end portion, a center portion and a second end portion arranged in succession along a longitudinal center axis of the heat transfer plate. The first end portion comprises a first and a second port hole and a first distribution area provided with a first distribution pattern. The second end portion comprises a third and a fourth port hole and a second distribution area provided with a second distribution pattern. The center portion comprises a heat transfer area provided with a heat transfer pattern differing from the first and second distribution patterns. The first end portion adjoins the center portion along a first borderline and the second end portion adjoins the center portion along a second borderline. The first and second distribution patterns each comprise distribution ridges and distribution valleys. A respective top portion of the distribution ridges extends in a first plane and a respective bottom portion of the distribution valleys extends in a second plane. The first and second planes are separated and parallel to each other. The distribution ridges longitudinally extend along a number of separated imaginary ridge lines extending from the first borderline towards the first port hole in the first distribution area, and from the second borderline towards the third port hole in the second distribution area. The distribution ridge along each one of the imaginary ridge lines arranged closest to the center portion forms an end ridge. The distribution valleys longitudinally extend along a number of separated imaginary valley lines extending from the first borderline towards the second port hole in the first distribution area, and from the second borderline towards the fourth porthole in the second distribution area. The distribution valley along each one of the imaginary valley lines arranged closest to the center portion forms an end valley. The imaginary ridge lines and the imaginary valley lines form a grid within each of the first and second distribution areas. The distribution valleys and distribution ridges defining each mesh of the grids enclose an area. Within this area the heat transfer plate extends at a distance >0 from the first plane and a distance >0 from the second plane, i.e. separated from the first and second planes. A width of the distribution ridges and distribution valleys, and the top and bottom portions thereof, is measured perpendicular to the imaginary ridge lines and valley lines. The heat transfer plate is characterized in that the top portion of at least a plurality, which may be a majority or even all, of the end ridges, along at least part of its longitudinal extension, has a second width exceeding a first width of the top portion of the rest of the distribution ridges. Further, the bottom portion of at least a plurality, which may be a majority or even all, of the end valleys, along at least part of its longitudinal extension, has a fourth width exceeding a third width of the bottom portion of the rest of the distribution valleys. The first and third widths may, or may not, be equal, and the second and fourth widths may, or may not, be equal.

Herein, if not stated otherwise, the ridges and valleys of the heat transfer plate are ridges and valleys when a front side of the heat transfer plate is viewed. Naturally, what is a ridge as seen from the front side of the plate is a valley as seen from an opposing back side of the plate, and what is a valley as seen from the front side of the plate is a ridge as seen from the back side of the plate, and vice versa.

Throughout the text, when referring to e.g. a line extending from something towards "something else", the line does not have to extend straight, but may extend obliquely, towards "something else".

The heat transfer plate may further comprise an outer edge portion enclosing the first and second end portions and the center portion. The outer edge portion may comprise corrugations extending between and in the first and second planes. The complete outer edge portion, or only one or more portions thereof, may comprise corrugations. The corrugations may be evenly or unevenly distributed along the edge portion, and they may, or may not, all look the same. The corrugations define ridges and valleys which may give the edge portion a wave-like design.

The corrugations may be arranged, at the front side of the heat transfer plate, to abut a first adjacent heat transfer plate, and at the opposing back side of the heat transfer plate, to abut a second adjacent heat transfer plate, when the heat transfer plate is arranged in a plate heat exchanger. The heat transfer plate and the first and second adjacent heat transfer plates may all be of the same type. Alternatively, the heat transfer plate and the first and second adjacent heat transfer plates may be of different types, as long as they are all configured according to claim 1.

The first and second distribution patterns are so-called chocolate patterns. At least some of the ridges and valleys of the first and second distribution patterns arranged closest to the central portion of the heat transfer plate, i.e. the end ridges and end valleys, have a configuration deviating from the configuration of the rest of the ridges and valleys in that they, and especially their top and bottom portions, are wider along at least part of their length. Thereby, they may offer larger contact areas than the rest of the ridges and valleys. Further, they may offer a shorter distance between adjacent contact areas than they could have done without the widening. Large and nearby contact areas may contribute positively to the strength of a plate pack comprising the inventive heat transfer plate. Also, since it is the end ridges and end valleys that present the widening, the strength is increased close to where it is needed the most, i.e. close to the transition between the first and second end portions and the central portion. As will be illustrated later on, the invention may be successfully applied both in a plate pack comprising plates "rotated" in relation to each other and in a plate pack comprising plates "flipped" in relation to each other. Naturally, the successful application is dependent on the design of the rest of the heat transfer plates in the plate pack.

The first and third port holes may be arranged on one side of the longitudinal center axis and the second and fourth port holes may be arranged on the other side of the longitudinal center axis. Thereby, the heat transfer plate may be suitable for use in a plate heat exchanger of so-called parallel flow type. Such a parallel-flow heat exchanger may comprise only one plate type. If instead the first and fourth portholes had been arranged on one and the same side, and the second and third porthole had been arranged on the same and the other side, of the longitudinal center axis, the plate could have been suitable for use in a plate heat exchanger of so-called diagonal flow type. Such a diagonal-flow heat exchanger may typically comprise more than one plate type.

Said at least a plurality of the end ridges may comprise a respective projection, such as a heel, to obtain the second width of the respective top portion. Further, said at least a plurality of the end valleys may comprise a respective projection, such as a heel, to obtain the fourth width of the respective bottom portion. The provision of projections constitutes a straightforward way of obtaining the desired widening of the end ridges and valleys, and especially the top and bottom portions thereof.

Alternatively, said at least a plurality of the end ridges and said at least a plurality of the end valleys could comprise two respective opposing projections to obtain the widening.

The projections of said at least a plurality of the end ridges may project so as to face a first edge, such as an edge of a longside, of the heat transfer plate. Further, the projections of said at least a plurality of the end valleys may project so as to face an opposite second edge, such as an edge of an opposing longside, of the heat transfer plate.

Alternatively, the projections of said at least a plurality of the end ridges and said at least a plurality of the end valleys could project so as to face the same edge of the heat transfer plate.

The heat transfer plate may be such that the top portion of said at least a plurality of the end ridges and the bottom portion of said at least a plurality of the end valleys each comprise a first part and a second part, which first and second parts are arranged in succession along the imaginary ridge and valley lines. The second part may, along at least part of its longitudinal extension, be wider than the first part. The second part may be closer to the first borderline than the first part in the first distribution area. Similarly, the second part may be closer to the second borderline than the first part in the second distribution area. Thereby, the heat transfer plate may provide an increased strength as close as possible to the first and second border lines, i.e. where it is needed the most.

The first and second parts may be integrally formed.

Said at least a plurality of the end ridges may be inverts of said at least a plurality of the end valleys. In other words, said at least a plurality of the end ridges as seen from the front side of the plate may have essentially the same form or shape and size, but not necessarily the same orientation, as said at least a plurality of the end ridges as seen from the back side of the plate (which are said at least a plurality of the end valleys as seen from the front side of the plate). Thereby, the size of the contact areas may be maximized.

The top portion of at least a plurality, which may be a majority or even all, of the distribution ridges not included in said at least a plurality of the end ridges, and the bottom portion of at least a plurality, which may be a majority or even all, of the distribution valleys not included in said at least a plurality of the end valleys, may have essentially the same width and an essentially uniform width along their longitudinal extension. This may facilitate the formation of maximum size contact areas in the case of plate "rotation" as well as plate "flipping".

A length of the distribution ridges and distribution valleys, and the top and bottom portions thereof, is measured parallel to the imaginary ridge lines and valley lines. The top portion of at least a plurality, which may be a majority or even all, of the distribution ridges not being end ridges, and the bottom portion of at least a plurality, which may be a majority or even all, of the distribution valleys not being end valleys, may have essentially the same length. This may facilitate the formation of maximum size contact areas in the case of plate "rotation" as well as plate "flipping".

A plurality of the distribution ridges may be arranged along each one of at least a plurality, which may be a majority or even all, of the imaginary ridge lines. Further, a plurality of the distribution valleys may be arranged along each one of at least a plurality, which may be a majority or even all, of the imaginary valley lines. This may facilitate the formation of a plurality of separated contact areas along at least a plurality of the imaginary ridge lines and valley lines.

The first and second borderlines may be non-straight, i.e. extend non-perpendicularly to the longitudinal center axis. Thereby, the bending strength of the heat transfer plate may be increased as compared to if the first and second borderlines instead was straight in which case the first and second borderlines could serve as bending lines of the heat transfer plate.

The first and second borderlines may be curved or arched or convex so as to bulge out towards the heat transfer area. Such curved first and second borderlines are longer than corresponding straight first and second borderlines would be, which results in a larger "outlet" and a larger "inlet" of the distribution areas. In turn, this contributes to the distribution of fluid across the width of the heat transfer plate and the collection of fluid having passed the heat transfer area. Thereby, the distribution areas can be made smaller with maintained distribution and collection efficiency.

Each of said at least a plurality of the end ridges may be arranged absolute adjacent to, i.e. at a zero distance from, a respective one of said at least a plurality of the end valleys. The projections of the end ridge and end valley of each pair of absolute adjacent end ridges and end valleys may face away from each other. The absolute adjacent end ridges and end valleys may be complete, i.e. not overlapping. By having the end ridges directly transitioning into the end valleys, a plane plate portion, which may function as a bending joint, between the end ridges and end valleys may be avoided whereby the strength of the plate is approved.

The top portion of each one of the end ridges may extend only outside an imaginary circle in the first plane, which circle has a center coinciding with a closest point on the top portion of an adjacent one of the end ridges and a radius equal to a length of an imaginary line drawn from the center, perpendicular to the corresponding imaginary ridge line, to an edge of the top portion of said each one of the end ridges. Thereby, it may be ensured that the distance between adjacent distribution ridges is not reduced so as to be smaller between adjacent end ridges which could result in a restriction of a fluid flow in the heat exchanger comprising the heat transfer plate.

A number of the imaginary ridge lines within the first distribution area arranged closest to the second port hole may be curved so as to bulge out as seen from the second porthole. Similarly, a number of the imaginary ridge lines within the second distribution area arranged closest to the fourth port hole may be curved so as to bulge out as seen from the fourth porthole. Further, a number of the imaginary valley lines within the first distribution area arranged closest to the first port hole may be curved so as to bulge out as seen from the first porthole. Similarly, a number of the imaginary valley lines within the second distribution area arranged closest to the third port hole may be curved so as to bulge out as seen from the third port hole. This may contribute to the distribution of fluid across the width of the heat transfer plate and the collection of fluid having passed the heat transfer area.

The second distribution pattern, the second borderline and the third and fourth portholes may be mirrorings, along a transverse center axis of the heat transfer plate extending perpendicular to the longitudinal center axis, of the first distribution pattern, the first borderline and the first and second portholes, respectively. This may enable an optimized formation of contact areas between the heat transfer plate and another heat transfer plate designed like this, irrespective of whether they are "rotated" or "flipped" in relation to each other.

The heat transfer plate may be such that a first volume enclosed by the heat transfer plate and the first plane is different from a second volume enclosed by the heat transfer plate and the second plane within the first and second distribution areas and the heat transfer area. This may enable formation of three different channel volumes by means of the heat transfer plate and another heat transfer plate designed like this. More particularly, one of the heat transfer plates may be "flipped" in relation to the other heat transfer plate wherein arrangement of the two heat transfer plates with their front sides facing each other results in a first channel volume, and arrangement of the two heat transfer plates with their back sides facing each other results in a second channel volume. Alternatively, one of the heat transfer plates may be "rotated" in relation to the other heat transfer plate which results in the front side of one of the heat transfer plates facing the back side of the other heat transfer plate, and a third channel volume. "Flipping" of the heat transfer plates in a plate pack comprising heat transfer plates constructed like this may thus result in asymmetric channels wherein every second channel has a larger volume than the rest of the channels, which may be desirable in some applications. Further, "rotation" of the heat transfer plates in a plate pack comprising heat transfer plates constructed like this may result in symmetric channels all having the same volume, which may be desirable in other applications.

The heat transfer plate may, within said area enclosed by the distribution ridges and distribution valleys, at least partly extend in a third plane displaced from the center plane extending half way between the first and second planes. This may be one way of obtaining different first and second volumes for a heat transfer plate.

The heat transfer pattern may comprise alternately arranged heat transfer ridges and heat transfer valleys in relation to the center plane. A respective top portion of the distribution ridges may extend in the first plane and a respective bottom portion of the distribution valleys may extend in the second plane. The distribution ridges may be more pointed than the distribution valleys. In other words, as seen from a cross section of the heat transfer pattern taken perpendicular to a longitudinal extension of the heat transfer ridges and valleys, the extension of the bottom portions of the heat transfer valleys may exceed the extension of the top portions of the heat transfer ridges. This may be one way of obtaining different first and second volumes for a heat transfer plate.

It should be stressed that the advantages of most, if not all, of the above discussed features of the inventive heat transfer plate appear when the heat transfer plate is combined with other suitably constructed heat transfer plates in a plate pack.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which.

DETAILED DESCRIPTION

Figure 1:
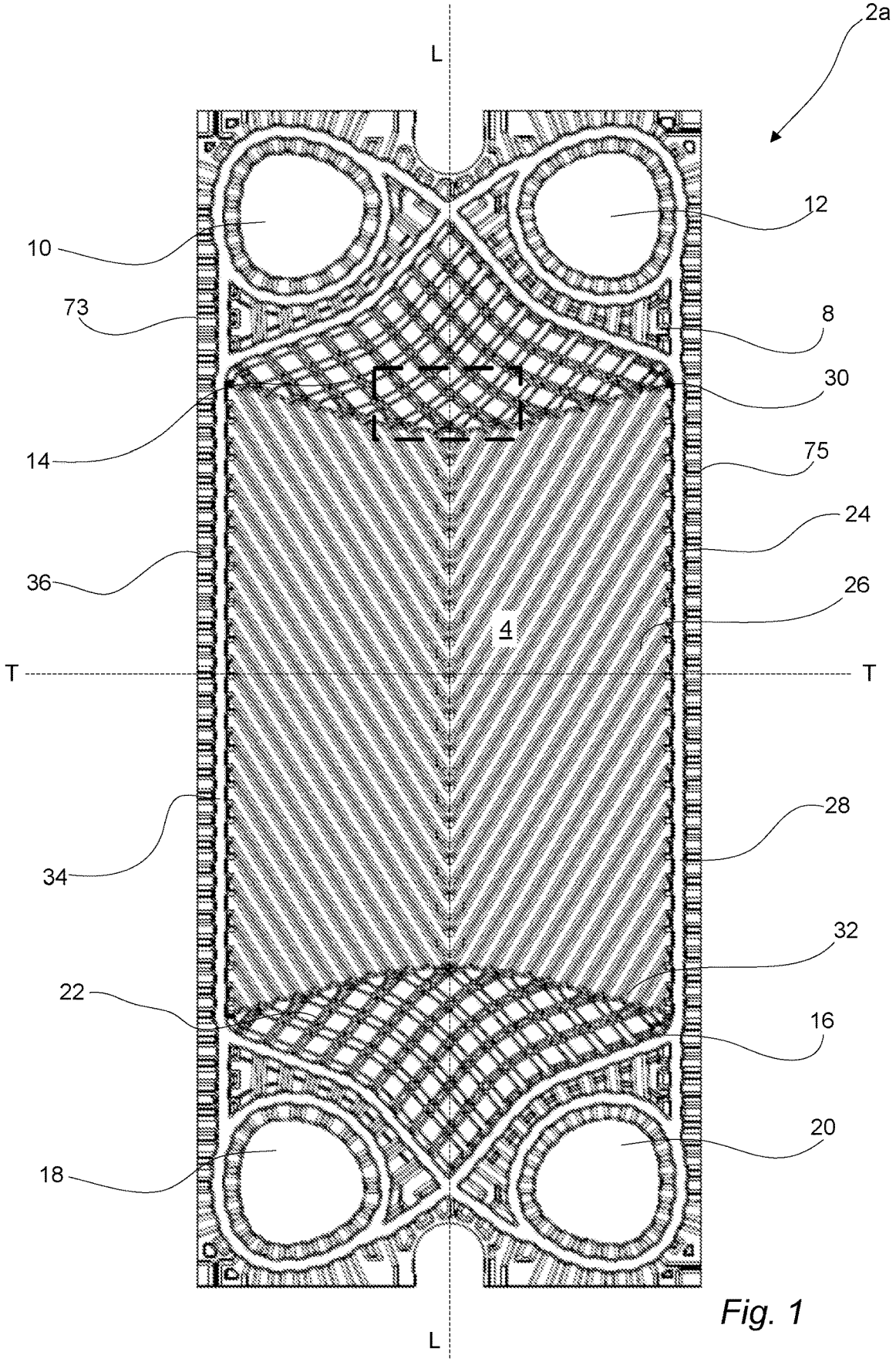
FIG. 1 is a schematic plan view of a heat transfer plate.
Figure 2:
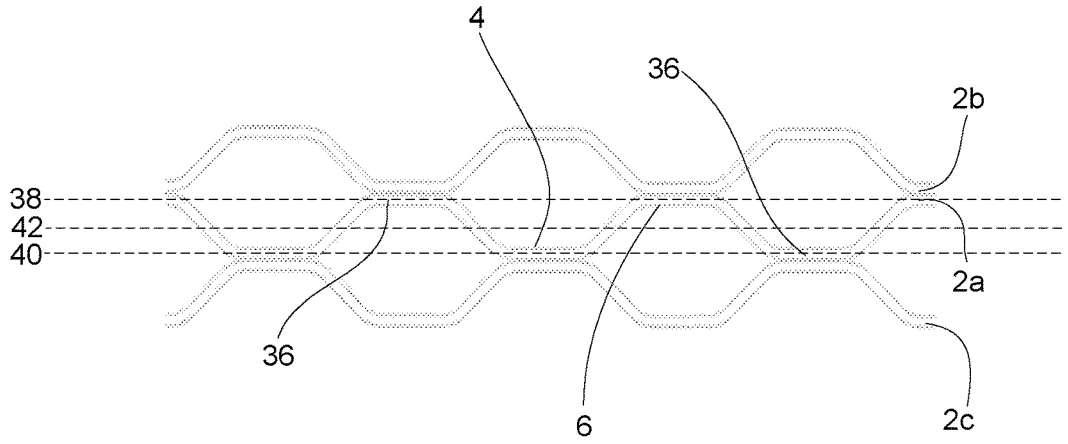
FIG. 2 illustrates abutting outer edges of adjacent heat transfer plates in a plate pack, as seen from the outside of the plate pack, FIG. 3 schematically illustrates a cross section through a heat transfer area of the heat transfer plate in FIG. 1, FIG. 4*a* contains an enlargement of a first distribution area of the heat transfer plate in FIG. 1, FIG. 4*b* contains an enlargement of a second distribution area of the heat transfer plate in FIG. 1, FIG. 5*a* schematically illustrates a cross section through the first or the second distribution area of the heat transfer plate in FIG. 1, FIG. 5*b* schematically illustrates another cross section through the first or the second distribution area of the heat transfer plate in FIG. 1, FIG. 6 contains an enlargement of a portion of the first distribution area of the heat transfer plate illustrated in FIG. 1, and FIG. 7 contains the enlargement of FIG. 6 and illustrates a limitation of an extension of end ridges of the first and second distribution areas.

FIG. 1 shows a heat transfer plate 2*a* of a gasketed plate heat exchanger as described by way of introduction. The gasketed PHE, which is not illustrated in full, comprises a pack of heat transfer plates 2 like the heat transfer plate 2*a*, i.e. a pack of similar heat transfer plates, separated by gaskets, which also are similar and which are not illustrated. With reference to FIG. 2, in the plate pack, a front side 4 (illustrated in FIG. 1) of the plate 2*a* faces an adjacent plate 2*b* while a back side 6 (not visible in FIG. 1 but indicated in FIG. 2) of the plate 2*a* faces another adjacent plate 2*c*.

With reference to FIG. 1, the heat transfer plate 2*a* is an essentially rectangular sheet of stainless steel. It comprises a first end portion 8, which in turn comprises a first port hole 10, a second port hole 12 and a first distribution area 14. The plate 2*a* further comprises a second end portion 16, which in turn comprises a third port hole 18, a fourth port hole 20 and a second distribution area 22. The plate 2*a* further comprises a center portion 24, which in turn comprises a heat transfer area 26, and an outer edge portion 28 extending around the first and second end portions 8 and 16 and the center portion 24. The first end portion 8 adjoins the center portion 24 along a first borderline 30 while the second end portion 16 adjoins the center portion 24 along a second borderline 32. The first and second borderlines 30 and 32 are arched so as to bulge towards each other. As is clear from FIG. 1, the first end portion 8, the center portion 24 and the second end portion 16 are arranged in succession along a longitudinal center axis L of the plate 2*a*, which extends perpendicular to a transverse center axis T of the plate 2*a*. As is also clear from FIG. 1, the first and third port holes 10 and 18 are arranged on one and the same side of the longitudinal center axis L, while the second and fourth port holes 12 and 20 are arranged on one and the other side of the longitudinal center axis L. Also, the heat transfer plate 2*a* comprises, as seen from the front side 4, a front gasket groove 34 and, as seen from the back side 6, a back gasket groove (not illustrated). The front and back gasket grooves are partly aligned with each other and arranged to receive a respective gasket.

The heat transfer plate 2*a* is pressed, in a conventional manner, in a pressing tool, to be given a desired structure, more particularly different corrugation patterns within different portions of the heat transfer plate. As was discussed by way of introduction, the corrugation patterns are optimized for the specific functions of the respective plate portions. Accordingly, the first distribution area 14 is provided with a first distribution pattern, the second distribution area 22 is provided with a second distribution pattern and the heat transfer area 26 is provided with a heat transfer pattern. Further, the outer edge portion 28 comprises corrugations 36 which make the outer edge portion stiffer and, thus, the heat transfer plate 2*a* more resistant to deformation. Further, the corrugations 36 form a support structure in that they are arranged to abut corrugations of the adjacent heat transfer plates in the plate pack of the PHE. With reference again to FIG. 2, illustrating the peripheral contact between the heat transfer plate 2*a* and the two adjacent heat transfer plates 2*b* and 2*c* of the plate pack, the corrugations 36 extend between and in a first plane 38 and a second plane 40, which are parallel to the figure plane of FIG. 1. A center plane 42 extends half way between the first and second planes 38 and 40, and a respective bottom of the front gasket groove 34 and back gasket groove extends in this center plane 42, i.e. in so called half plane.

Figure 3:
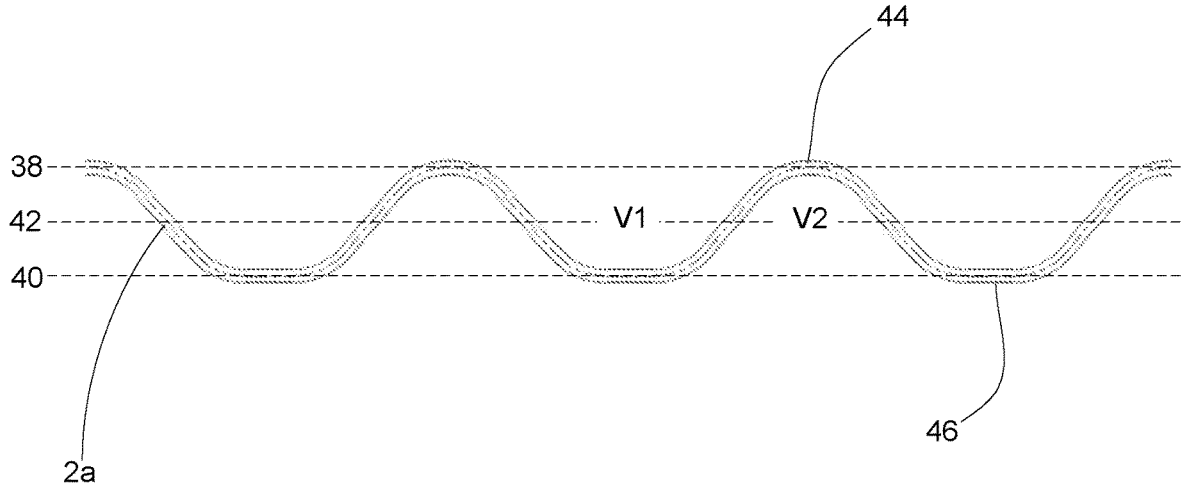

The heat transfer pattern is of so-called herringbone type and comprises V-shaped heat transfer ridges 44 and heat transfer valleys 46 alternately arranged along the longitudinal center axis L. With reference to FIG. 3 schematically illustrating a cross section of the plate 2*a* within the heat transfer area 26, taken perpendicular to a longitudinal extension of the heat transfer ridges and valleys 44 and 46, the heat transfer ridges 44 and valleys 46 extend between and in the first plane 38 and the second plane 40. As is illustrated in FIG. 3, the heat transfer ridges and valleys 44 and 46 are not symmetrical with respect to the center plane 42. Instead, the heat transfer valleys 46 are wider or less pointed than the heat transfer ridges 44. Consequently, within the heat transfer area 26, a first volume V1 enclosed by the plate 2*a* and the first plane 38 will be larger than a second volume V2 enclosed by the plate 2*a* and the second plane 40.

Figure 4A:
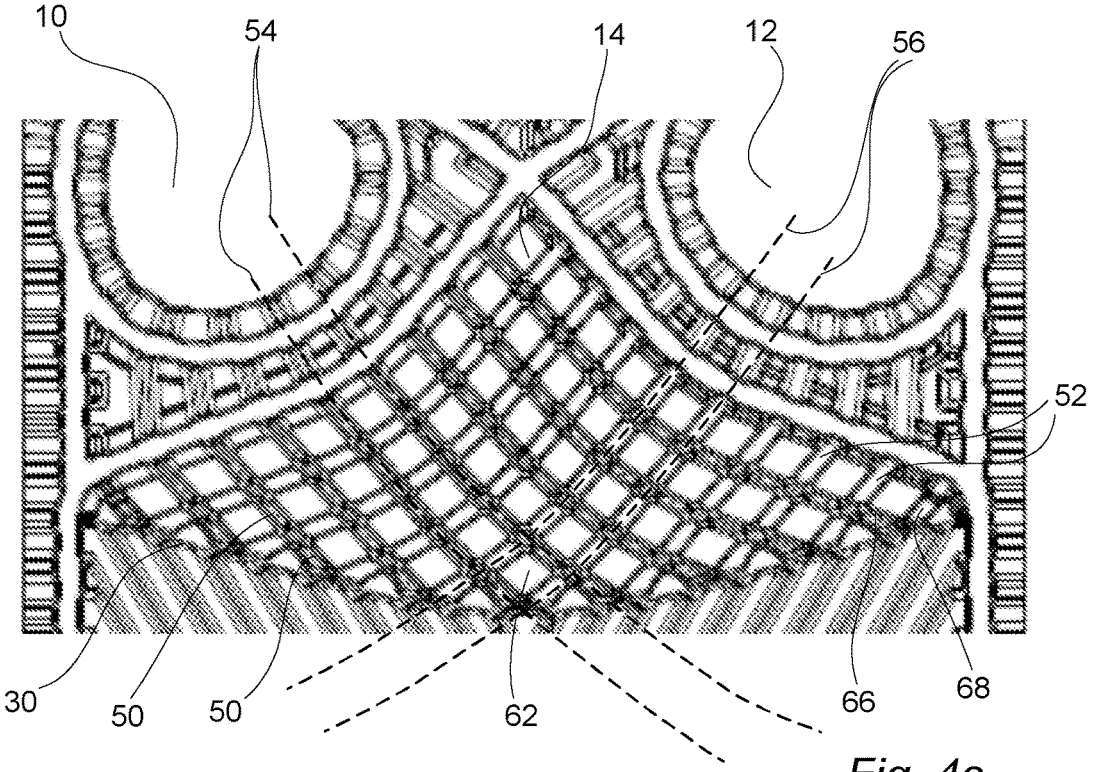
Figure 4B:
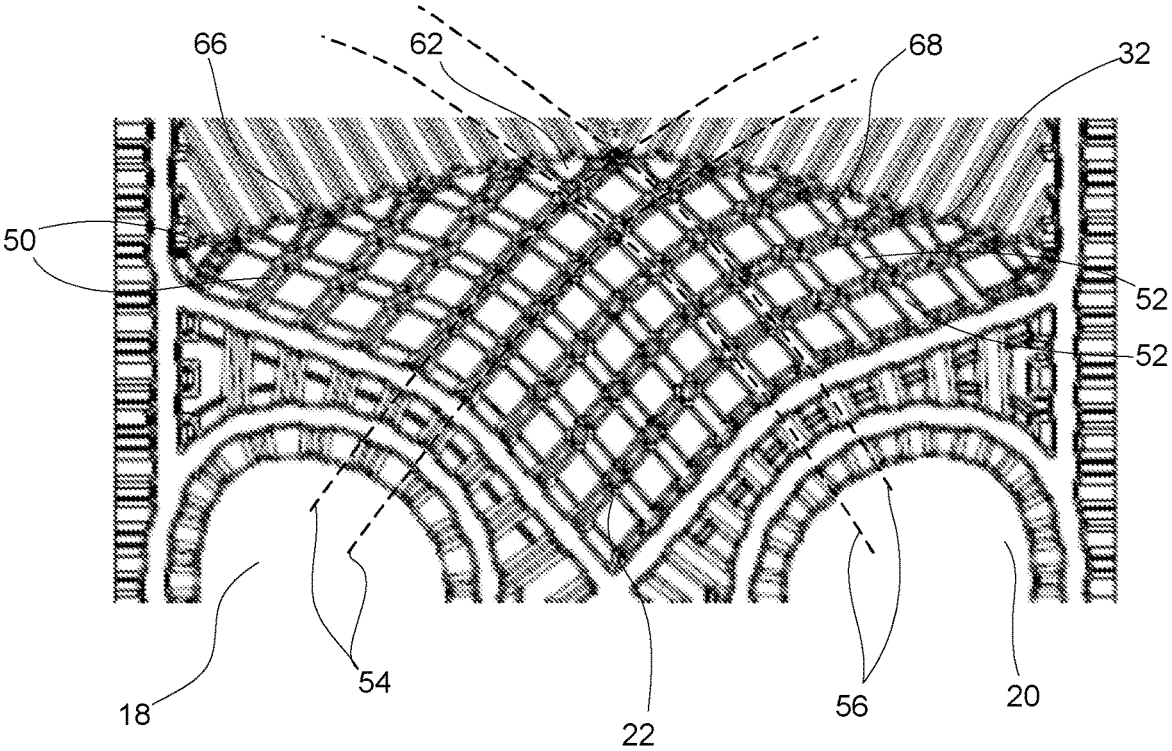

With reference to FIGS. 4*a* and 4*b* which show enlargements of parts of the plate 2*a*, the first and second distribution patterns, which are similar, each comprise elongate distribution ridges 50 and elongate distribution valleys 52. The distribution ridges 50 are divided into sets. The distribution ridges 50 of each set are arranged, longitudinally extending, along one of a number of separated imaginary ridge lines 54, of which only a few are illustrated by broken lines in FIGS. 4*a* and 4*b*. Similarly, the distribution valleys 52 are divided into sets. The distribution valleys 52 of each set are arranged, longitudinally extending, along one of a number of separated imaginary valley lines 56, of which only a few are illustrated by broken lines in FIGS. 4*a* and 4*b*. As is illustrated in FIG. 4*a*, in the first distribution area 14 the imaginary ridge lines 54 extend from the first borderline 30 towards the first porthole 10 while the imaginary valley lines 56 extend from the first borderline 30 towards the second porthole 12. Similarly, as is illustrated in FIG. 4*b*, in the second distribution area 22 the imaginary ridge lines 54 extend from the second borderline 32 towards the third porthole 18 while the imaginary valley lines 56 extend from the second borderline 32 towards the fourth porthole 20. As is shown in FIGS. 4*a* and 4*b*, the imaginary ridge and valley lines 54 and 56 with the largest sets of distribution ridges and valleys are curved so as to bulge out towards the respective one of the first and second borderlines 30 and 32, while the rest of, i.e. the imaginary ridge and valley lines 54 and 56 with the smallest sets of distribution ridges and valleys, are essentially straight. The imaginary ridge and valley lines 54 and 56 cross each other so as to form an imaginary grid within each of the first and second distribution areas 14 and 22. These grids comprises meshes, wherein the meshes immediately adjacent the first and second borderlines 30 and 32 are open and the rest of the meshes are closed.

Figure 5A:
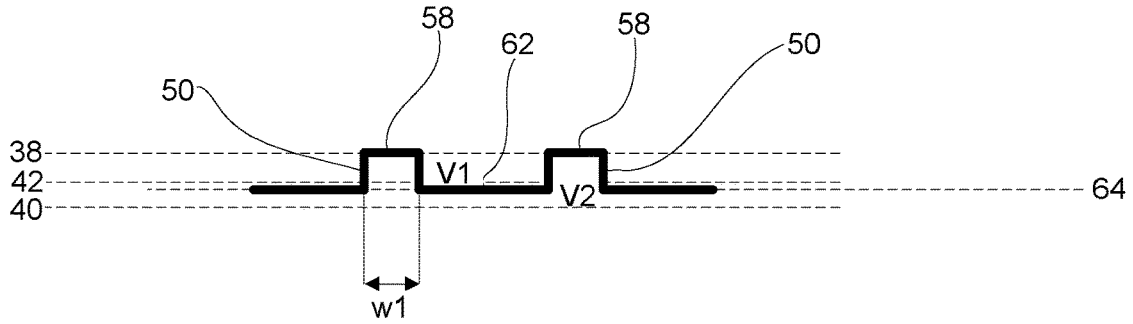
Figure 5B:
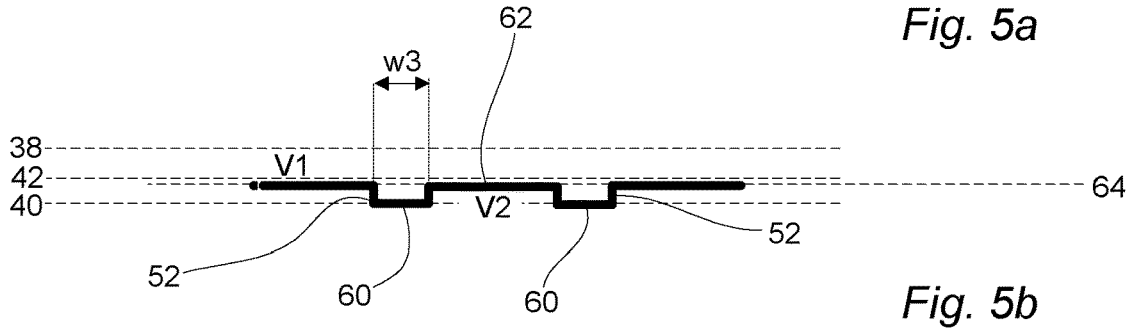

FIG. 5*a* schematically illustrates a cross section of the first and second distribution areas 14 and 22 taken between two adjacent ones of the imaginary valley lines 56, while FIG. 5*b* schematically illustrates a cross section of the first and second distribution areas 14 and 22 taken between two adjacent ones of the imaginary ridge lines 54. As is clear from FIGS. 5*a* and 5*b*, a respective top portion 58 of the distribution ridges 50 extend in the first plane 38, while a respective bottom portion 60 of the distribution valleys 52 extend in the second plane 40. Further, the distribution ridges 50 and distribution valleys 52 defining each mesh of the grids enclose, completely in the case of a closed mesh and partly in the case of an open mesh, a triangular or quadrangular area 62, as is also illustrated in FIGS. 4*a* and 4*b*. This area 62 extends in a third plane 64 arranged between the second plane 40 and center plane 42. Since the third plane 64 is displaced from the center plane 42, the first volume V1 enclosed by the plate 2*a* and the first plane 38 will be larger than the second volume V2 enclosed by the plate 2*a* and the second plane 40, within the first and second distribution areas 14 and 22.

Between two adjacent ones of the distribution ridges 50 along one and the same one of the imaginary ridge lines 54, and between two adjacent ones of the distribution valleys 52 along one and the same one of the imaginary valley lines 56, the plate 2*a* here extends in the center plane 42 (but this could be different in other embodiments).

The distribution ridge 50 along each of the imaginary ridge lines 54 that is arranged closest to the first borderline 30 in the first distribution area 14, and closest to the second borderline 32 in the second distribution area 22, forms a respective end ridge 66. In a corresponding way, the distribution valley 52 along each of the imaginary valley lines 56 that is arranged closest to the second borderline 30 in the first distribution area 14, and closest to the second borderline 32 in the second distribution area 22, forms a respective end valley 68. The end ridges 66 as seen from the front side 4 of the plate 2*a* and the end valleys 68 as seen from the opposite back side of the plate 2*a*, where they form end ridges, have the same shape. This means that the end ridges 66 are inverts of the end valleys 68. Each of the end ridges 66 is arranged right beside a respective one of the end valleys 68.

The width of the distribution ridges 50 and distribution valleys 52, and especially the top and bottom portions 58, 60 thereof, is measured perpendicular to the imaginary ridge lines 54 and the imaginary valley lines 56, respectively. The top portion 58 of the distribution ridges 50 not being end ridges 66, and the bottom portion 60 of the distribution valleys 52 not being end valleys 68 have the same width w1=w3 (FIGS. 5*a* and 5*b*), and the width is constant along essentially their complete longitudinal extension. The length of the top portion 58 of the distribution ridges 50 and the bottom portion 60 of the distribution valleys 52 is their longitudinal extension, and this is measured parallel to the respective imaginary ridge lines and valley lines 54 and 56. As is clear from FIGS. 4*a* and 4*b*, the top and bottom portions 58, 60 of most of the distribution ridges 50 and distribution valleys 52 (not the ones most adjacent to the portholes 10, 12, 18 and 20) not being end ridges 66 and end valleys 68 have essentially the same length.

Figure 6:
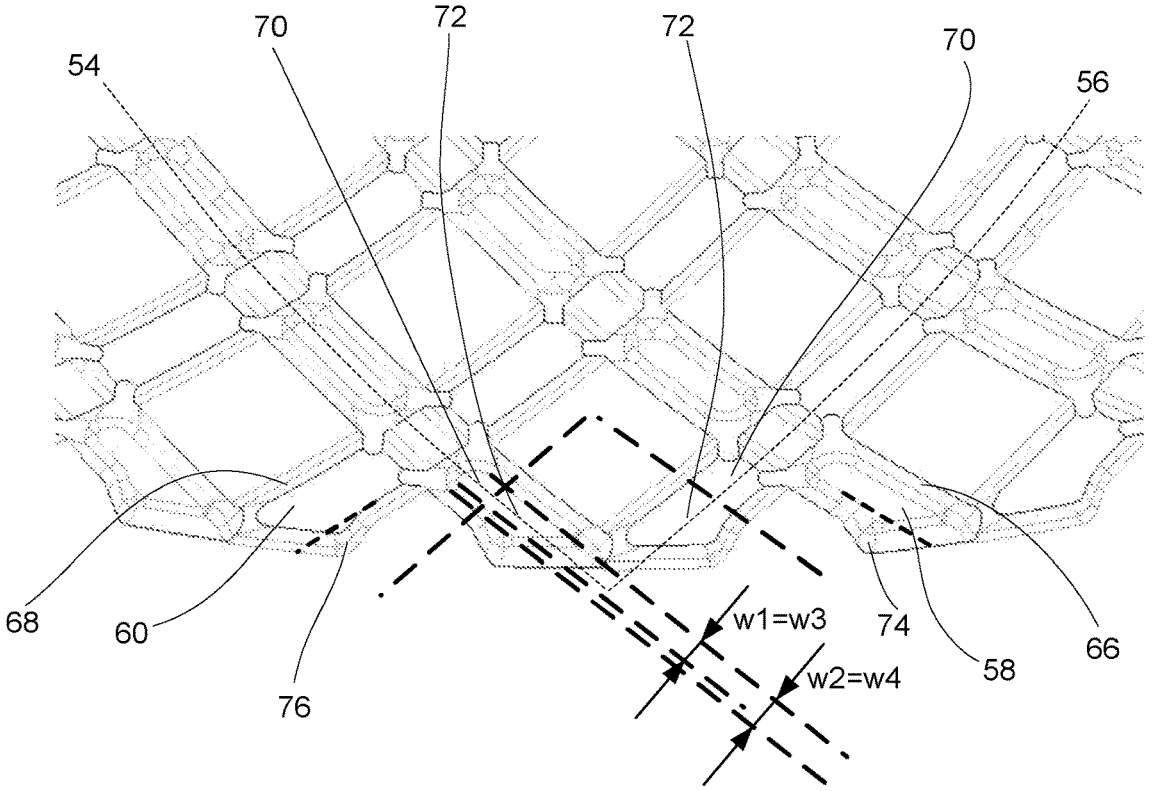

The end ridges 66 and end valleys 68 have a shape deviating from the shape of the rest of the distribution ridges 50 and distribution valleys 52. FIG. 6 contains an enlargement of the first distribution area 14 within the box drawn with ghost lines in FIG. 1. As is clear from FIG. 6, the top portion 58 of the end ridges 66 and the bottom portion 60 of the end valleys 68 each comprise a first part 70 and a second part 72 arranged in succession along the corresponding one of the imaginary ridge and valley lines 54 and 56. Within the first distribution area 14 the second part 72 is the part most adjacent to the first borderline 30, and within the second distribution area 22 the second part 72 is the part most adjacent to the second borderline 32 (borderlines 30 and 32 illustrated in FIG. 1). The width of the first parts is w1=w3. The second parts 72 each comprise an outside heel or projection, denoted 74 for the end ridges 66 and 76 for the end valleys 68, which results in a local widening of the corresponding end ridge 66 or end valley 68, and the top and bottom portions 58, 60 thereof. Thus, along part of their longitudinal extension, the second parts have a width w2=w4 which is larger than w1=w3.

As is clear from the figures, the projections 74 of the end ridges 66 project so as to face a first edge 73 (FIG. 1) of the heat transfer plate 2, and the projections 76 of the end valleys 68 project so as to face an opposite second edge 75 (FIG. 1) of the heat transfer plate 2.

As is indicated by FIG. 1, the first porthole 10, the second porthole 12, the first borderline 30 and the first distribution area 14 including the first distribution pattern, on the one hand, and the third porthole 18, the fourth port hole 20, the second borderline 32 and the second distribution area 22 including the second distribution pattern, on the other hand, are symmetrical, or mirrorings of each other, with reference to the transverse center axis T.

As previously said, in the plate pack, the plate 2*a* is arranged between the plates 2*b* and 2*c*. The plates 2*b* and 2*c* may be arranged either "flipped" or "rotated" in relation to the plate 2*a*.

If the plates 2*b* and 2*c* are arranged "flipped" in relation to the plate 2*a*, the front side 4 and back side 6 of plate 2*a* face the front side 4 of plate 2*b* and the back side 6 of plate 2*c*, respectively. This means that the ridges of plate 2*a* will abut the ridges of plate 2*b* while the valleys of plate 2*a* will abut the valleys of plate 2*c*. More particularly, the heat transfer ridges 44 and heat transfer valleys of the plate 2*a* will abut, in pointlike contact areas, the heat transfer ridges 44 of the plate 2*b* and the heat transfer valleys 46 of the plate 2*c*, respectively. Further, the top portions 58 of the distribution ridges 50 and the bottom portions 60 of the distribution valleys 52 of the plate 2*a* will abut, in elongate contact areas, the top portions 58 of the distribution ridges 50 of the plate 2*b* and the bottom portions 60 of the distribution valleys 52 of the plate 2*c*, respectively. Because of the heels 74 and 76 of the end ridges 66 and end valleys, the contact areas closest to the first and second border lines 30 and 32 will be locally widened to provide extra strength to the plate pack close to the transitions between the heat transfer and distribution areas 26, 14 and 22. The plates 2*a* and 2*b* will form a channel of volume 2×V1, while the plates 2*a* and 2*b* will form a channel of volume 2×V2, i.e. two assymetric channels since V1>V2.

If the plates 2*b* and 2*c* are arranged "rotated" in relation to the plate 2*a*, the front side 4 and back side 6 of plate 2*a* face the back side 6 of plate 2*b* and the front side 4 of plate 2*c*, respectively. This means that the ridges of plate 2*a* will abut the valleys of plate 2*b* while the valleys of plate 2*a* will abut the ridges of plate 2*c*. More particularly, the heat transfer ridges 44 and heat transfer valleys of the plate 2*a* will abut, in pointlike contact areas, the heat transfer valleys 46 of the plate 2*b* and the heat transfer ridges 44 of the plate 2*c*, respectively. Further, the top portions 58 of the distribution ridges 50 and the bottom portions 60 of the distribution valleys 52 of the plate 2*a* will abut, in elongate contact areas, the bottom portions 60 of the distribution valleys 52 of the plate 2*b* and the top portions 58 of the distribution ridges 50 of the plate 2*c*, respectively. Because of the heels 74 and 76 of the end ridges 66 and end valleys, the contact areas closest to the first and second border lines 30 and 32 will be locally widened to provide extra strength to the plate pack close to the transitions between the heat transfer and distribution areas 26, 14 and 22. The plates 2*a* and 2*b* will form a channel of volume V1+V2, while the plates 2*a* and 2*b* will form a channel of volume V1+V2, i.e. two symmetric channels.

The above described embodiment of the present invention should only be seen as an example. A person skilled in the art realizes that the embodiment discussed can be varied in a number of ways without deviating from the inventive conception.

For example, the heat transfer area may comprise other heat transfer patterns, both symmetric and asymmetric, and both of herringbone-type and other types, than the one described above.

Similarly, the first and second distribution areas may comprise other distribution patterns than the one described above. As an example, the third plane could be arranged closer to, or more distant from, the first plane than illustrated in the drawings. As another example, the first and second distribution patterns need not be asymmetric, i.e. the third plane could coincide with the center plane.

The plate pack described above contains only plates of one type. The plate pack could instead comprise plates of two or more different types, such as plates having differently configurated heat transfer patterns.

The end ridges and end valleys need not all be provided with heels. The heels of some or all of the end ridges may differ in form and/or size from the heels of some or all of the end valleys. Further, alternative designs of the distribution ridges and distribution valleys are possible. For example, all the distribution ridges and valleys could be straight, and/or they could have a varying design such as different lengths and widths.

Figure 7:
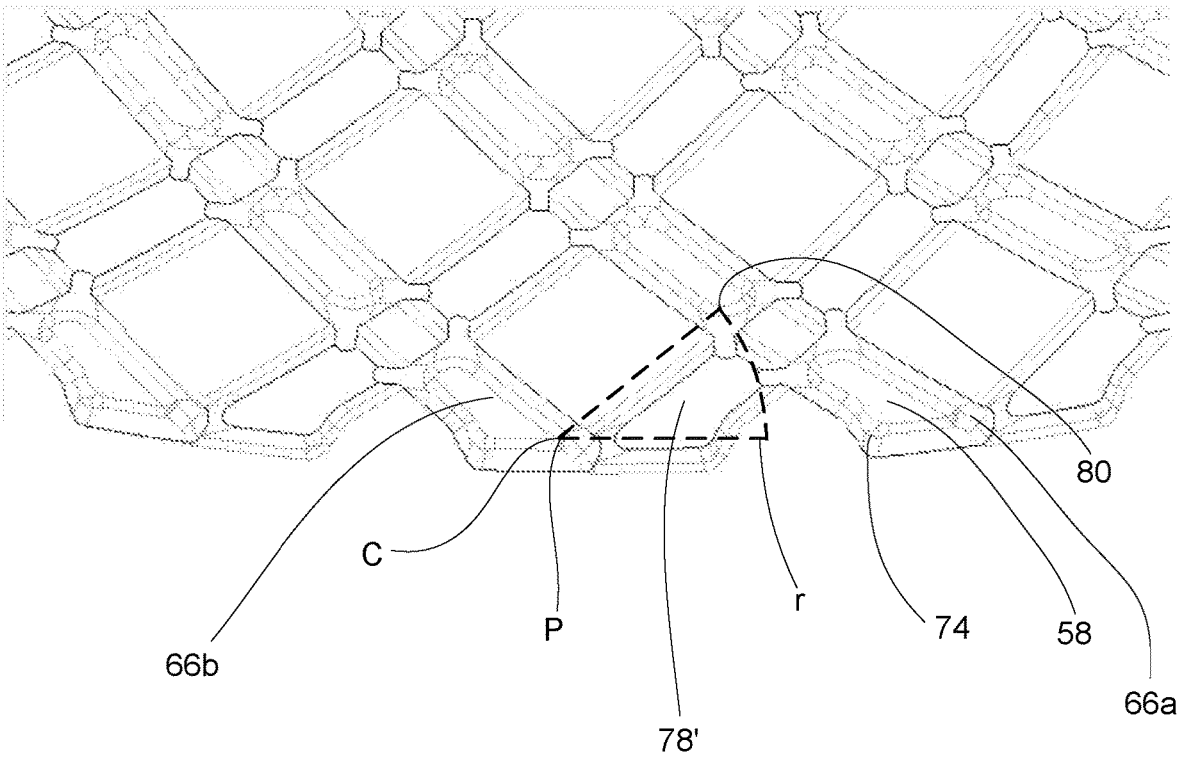

The heels need not be designed as illustrated in the drawings but could, for example, be larger or smaller. FIG. 7 illustrates a possible maximum extension of the heels. Preferably, the top portion 58 of a first end ridge 66*a* should not extend inside a certain imaginary circle 78 (of which only a circle sector 78' is illustrated) in the first plane 38. This imaginary circle 78 has a center C coinciding with a point P on the top portion 58 of an adjacent second end ridge 66*b*, which point is closest to the first end ridge 66. Further, the imaginary circle 78 has a radius r equal to the length of an imaginary line drawn from the center C of the imaginary circle 78, perpendicular to the imaginary ridge line 54 along which the second end ridge 66*b* is arranged, to an edge 80 of the top portion 58 of the first end ridge 66*a*.

The first and second borderlines need not be curved but could have other forms. For example, they could be straight or zig-zag shaped.

The heat transfer plate could additionally comprise a transition band, like the ones described in EP 2957851, EP 2728292 or EP 1899671, between the heat transfer and distribution areas. Such a plate may not be "flippable" as well as "rotatable".

The present invention is not limited to gasketed plate heat exchangers but could also be used in welded, semi-welded, brazed and fusion-bonded plate heat exchangers.

The heat transfer plate need not be rectangular but may have other shapes, such as essentially rectangular with rounded corners instead of right corners, circular or oval. The heat transfer plate need not be made of stainless steel but could be of other materials, such as titanium or aluminium.

The triangular and quadrangular areas enclosed by the distribution ridges and valleys need not be flat and extend completely in the third plane.

It should be stressed that the attributes front, back, first, second, third, etc. is used herein just to distinguish between details and not to express any kind of orientation or mutual order between the details.

Further, it should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

The invention claimed is:

1. A heat transfer plate comprising a first end portion, a center portion and a second end portion arranged in succession along a longitudinal center axis of the heat transfer plate, the first end portion comprising a first port hole and a second port hole and a first distribution area provided with a first distribution pattern, the second end portion comprising a third port hole and a fourth port hole and a second distribution area provided with a second distribution pattern, and the center portion comprising a heat transfer area provided with a heat transfer pattern differing from the first and second distribution patterns, the first end portion adjoining the center portion along a first borderline and the second end portion adjoining the center portion along a second borderline, wherein the first and second distribution patterns comprise distribution ridges and distribution valleys, a respective top portion of the distribution ridges extending in a first plane and a respective bottom portion of the distribution valleys extending in a second plane, which first and second planes are parallel to each other, the distribution ridges longitudinally extending along a number of separated imaginary ridge lines extending from the first borderline towards the first port hole in the first distribution area, and from the second borderline towards the third port hole in the second distribution area, the distribution ridge along each one of the imaginary ridge lines arranged closest to the center portion forming an end ridge, and the distribution valleys longitudinally extending along a number of separated imaginary valley lines extending from the first borderline towards the second port hole in the first distribution area, and from the second borderline towards the fourth port hole in the second distribution area, the distribution valley along each one of the imaginary valley lines arranged closest to the center portion forming an end valley, wherein the imaginary ridge lines and the imaginary valley lines form a grid within each of the first and second distribution areas, wherein the distribution valleys and distribution ridges defining each mesh of the grids enclose an area within which the heat transfer plate extends at a distance >0 from the first plane and a distance >0 from the second plane, wherein a width of the top portion of the distribution ridges and the bottom portion of the distribution valleys is measured perpendicular to the imaginary ridge lines and valley lines, wherein a top portion of at least a plurality of the end ridges, along at least part of a longitudinal extension of the end ridges, has a second width exceeding a first width of the top portion of the rest of the distribution ridges, and a bottom portion of at least a plurality of the end valleys, along at least part of a longitudinal extension of the end valleys, has a fourth width exceeding a third width of the bottom portion of the rest of the distribution valleys.

2. A heat transfer plate according to claim 1, wherein the first and third port holes are arranged on one side of the longitudinal center axis and the second and fourth port holes are arranged on the other side of the longitudinal center axis.

3. A heat transfer plate according to claim 1, wherein said at least a plurality of the end ridges comprise a respective projection to obtain the second width of the respective top portion, and said at least a plurality of the end valleys comprise a respective projection to obtain the fourth width of the respective bottom portion.

4. A heat transfer plate according to claim 3, wherein the projections of said at least a plurality of the end ridges project so as to face a first edge of the heat transfer plate, and the projections of said at least a plurality of the end valleys project so as to face an opposite second edge of the heat transfer plate.

5. A heat transfer plate according claim 1, wherein the top portion of said at least a plurality of the end ridges and the bottom portion of said at least a plurality of the end valleys each comprise a first part and a second part, which first and second parts are arranged in succession along the imaginary ridge and valley lines, the second part, along at least part of the respective longitudinal extension of the end ridges and the end valleys, being wider than the first part, the second part being closer to the first borderline than the first part in the first distribution area, and the second part being closer to the second borderline than the first part in the second distribution area.

6. A heat transfer plate according to claim 1, wherein said at least a plurality of the end ridges are inverts of said at least a plurality of the end valleys.

7. A heat transfer plate according to claim 1, wherein the top portion of at least a plurality of the distribution ridges not included in said at least a plurality of the end ridges, and the bottom portion of at least a plurality of the distribution valleys not included in said at least a plurality of the end valleys, have essentially the same width and an essentially uniform width along the respective longitudinal extension of the distribution ridges and the distribution valleys.

8. A heat transfer plate according to claim 1, wherein a length of the top portion of the distribution ridges and the bottom portion of the distribution valleys is measured parallel to the imaginary ridge lines and valley lines, the top portion of at least a plurality of the distribution ridges which are not end ridges and the bottom portion of at least a plurality of the distribution valleys which are not end valleys having essentially the same length.

9. A heat transfer plate according to claim 1, wherein a plurality of the distribution ridges are arranged along each one of at least a plurality of the imaginary ridge lines and a plurality of the distribution valleys are arranged along each one of at least a plurality of the imaginary valley lines.

10. A heat transfer plate according to claim 1, wherein the first and second borderlines are non-straight.

11. A heat transfer plate according to claim 1, wherein said at least a plurality of the end ridges each is arranged absolute adjacent to a respective one of said at least a plurality of the end valleys.

12. A heat transfer plate according to claim 1, wherein the top portion of each one of the end ridges extends only outside an imaginary circle in the first plane, which circle has a center coinciding with a closest point on the top portion of an adjacent one of the end ridges and a radius equal to a length of an imaginary line drawn from the center, perpendicular to the corresponding imaginary ridge line, to an edge of the top portion of said each one of the end ridges.

13. A heat transfer plate according to claim 1, wherein a number of the imaginary ridge lines within the first distribution area arranged closest to the second port hole are curved so as to bulge out as seen from the second porthole, a number of the imaginary ridge lines within the second distribution area arranged closest to the fourth port hole are curved so as to bulge out as seen from the fourth porthole, a number of the imaginary valley lines within the first distribution area arranged closest to the first port hole are curved so as to bulge out as seen from the first porthole, and a number of the imaginary valley lines within the second distribution area arranged closest to the third port hole are curved so as to bulge out as seen from the third port hole.

14. A heat transfer plate according to claim 1, wherein a first volume enclosed by the heat transfer plate and the first plane is different from a second volume enclosed by the heat transfer plate and the second plane within the first and second distribution areas and the heat transfer area.

15. A heat transfer plate according to claim 1, which within said area enclosed by the distribution ridges and distribution valleys at least partly extends in a third plane displaced from a center plane extending half way between the first and second planes.

* * * * *